US005839596A

United States Patent [19]

Zahn et al.

[11] Patent Number: 5,839,596

[45] Date of Patent: Nov. 24, 1998

[54] CUP TOP AND CAN ADAPTER

[76] Inventors: Scott M. Zahn, 927 Tall Timber Rd., Nisswa, Minn. 56468; Mark C. Zahn, 1391 Danielson Rd., Brainerd, Minn. 56401

[21] Appl. No.: 779,246

[22] Filed: Dec. 17, 1996

Related U.S. Application Data

[60] Provisional application No. 60/009,674 Jan. 2, 1996.

[51] Int. Cl.[6] ..... B65D 45/02

[52] U.S. Cl. ..... 220/256; 220/793; 220/711; 220/740

[58] Field of Search ..... 220/703, 711, 220/713, 714, 716, 718, 737, 739, 740, 367.1, 253, 256, 258, 903, 906, 780, 793, 795; 222/183, 485.1, 130, 131

[56] References Cited

U.S. PATENT DOCUMENTS

| | | | |
|---|---|---|---|
| 2,294,393 | 9/1942 | Erne | 220/737 X |
| 2,345,971 | 4/1944 | Hamilton et al. | 220/737 X |
| 4,579,257 | 4/1986 | Brandlein | 220/713 X |
| 4,752,016 | 6/1988 | Eads | 220/713 X |
| 4,883,192 | 11/1989 | Krugman | 220/711 |
| 4,938,379 | 7/1990 | Kellner | 220/713 X |
| 5,071,042 | 12/1991 | Esposito | 220/711 X |
| 5,186,350 | 2/1993 | McBride | 220/740 X |
| 5,261,554 | 11/1993 | Forbes | 220/739 X |
| 5,398,842 | 3/1995 | Sokolski et al. | 220/739 X |

FOREIGN PATENT DOCUMENTS

| | | | |
|---|---|---|---|
| 94235 | 11/1983 | European Pat. Off. | 220/713 |
| 2240332 | 7/1991 | United Kingdom | 220/737 |

*Primary Examiner*—Stephen K. Cronin
*Assistant Examiner*—Nathan Newhouse

[57] ABSTRACT

A beverage dispensing mug and an adapter top for a beverage dispensing mug which is capable of receiving a conventional beverage can whereby the contents of the can may be maintained in a chilled condition and/or consumed without emptying the contents of the can into the mug.

20 Claims, 3 Drawing Sheets

CUP TOP AND CAN ADAPTER

This application claims the benefit of Provisional Application Ser. No. 60/009,674 filed Jan. 2, 1996.

BACKGROUND OF THE INVENTION

1. Field of the Invention

The present invention relates generally to a cup top and can adapter, and more particularly, to a cup top for an insulated beverage dispensing container such as a mug or the like with a built-in can adapter.

2. Description of the Prior Art

A variety of insulated beverage dispensing containers, and particularly mugs, currently exist for dispensing hot or cold beverages. Many of these insulated mugs have removable tops which snap over the top edge of the mug and include drinking openings for consumption of the beverage. One of the most popular of these insulated mugs is a twelve-ounce mug with a snap-on top manufactured and sold by Aladdin. In addition to the mug itself, the mug top assists in keeping the beverage within the mug at the desired temperature (either hot or cold) for an extended period of time.

Although the insulated mugs with presently available mug tops function satisfactorily to maintain beverages at a desired hot or cold temperature, they are applicable only to beverages which have already been poured or removed from their primary container. For example, to use currently available insulated mugs with a can of cold pop or other beverage, the can must be opened and the contents poured into the cup before the mug can be used to maintain such beverage at a cold temperature either prior to or during consumption.

Accordingly, there is a need in the art for an insulated mug and associated top which will receive a can of cold pop or other beverage, keep it cold, and allow it to be consumed or dispensed from the mug without first emptying the contents of the can into the mug.

SUMMARY OF THE INVENTION

In contrast to the prior art, the present invention relates to a top and can adapter for an insulated mug or other beverage dispensing container which permits the insulated mug to receive a can of cold pop or other beverage and not only maintain it at a desired cold temperature, but permit the beverage to be consumed or otherwise dispensed without first emptying the contents of the can into the mug.

More specifically, the top and can adapter of the present invention includes a mug engaging edge designed to be snapped onto the top edge of an insulated mug, a wall portion extending from the mug engaging edge to an adapter top and a can engaging means in the form of a can engaging lip or recess or a gasket for engaging an edge portion of a can in substantially sealed relationship. The device also includes a beverage dispensing opening in the adapter top and a dispensing wall and edge.

In the preferred embodiment of the present invention, it is contemplated that the insulated mug will be shorter than a standard soft drink or beer can with which it is used. Thus, the adapter wall will extend upwardly from the mug engaging edge so that the can engaging portion of the adapter top is positioned above the top edge of the mug. It is also anticipated, however, that the insulated mug or other container could be taller than a conventional soft drink can. In such case, the adapter wall would extend downwardly relative to the mug connection edge with the can connection portion positioned below the mug top edge.

Accordingly, it is an object of the present invention to provide a modified top for an insulated mug or other beverage container which will enable the mug to receive a can of cold pop or other beverage.

Another object of the present invention is to provide a top and can adapter for an insulated mug which will enable the mug to receive a conventional soft drink can, maintain it in a chilled condition and allow it to be consumed or otherwise dispensed without emptying the contents of the can into the mug.

These and other objects of the present invention will become apparent with reference to the drawings, the description of the preferred embodiment and the appended claims.

DESCRIPTION OF THE PREFERRED EMBODIMENT

Figure 1:
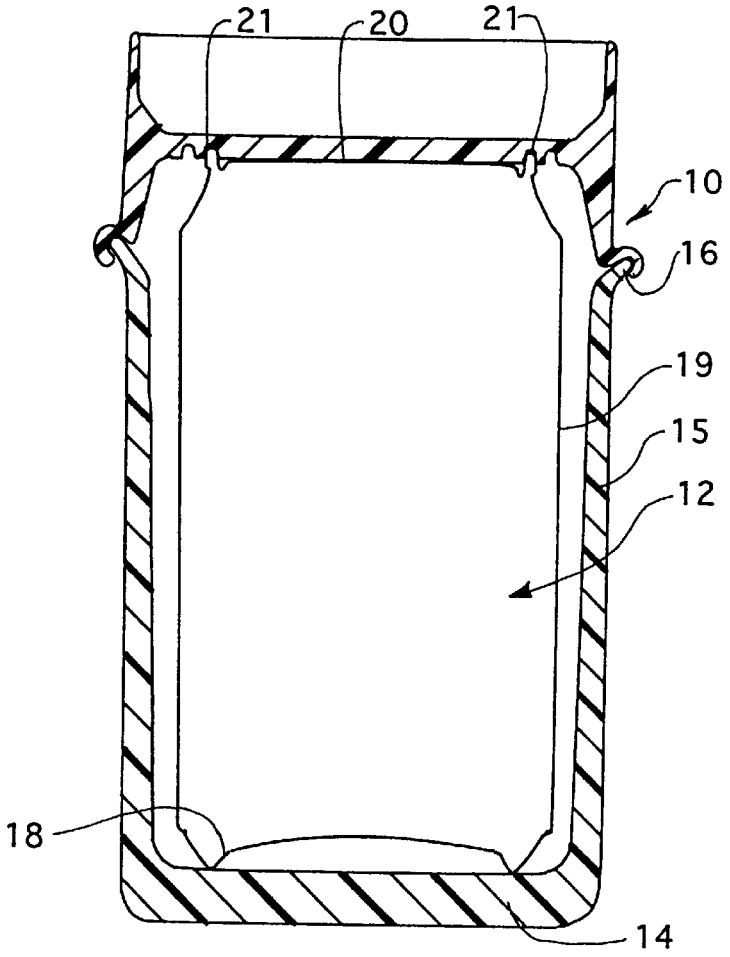
FIG. 1 is an elevational front view, partially in section, showing an insulated mug, a can and the mug top and can adapter of the present invention.

Reference is first made to FIG. 1 showing the mug top and can adapter 10 of the present invention as used with an insulated mug 11 and a conventional soft drink or other beverage can 12. The mug 11 includes a bottom 14, a generally cylindrical or slightly frusto conical side wall 15 and a top edge 16. As shown, the edge 16 extends outwardly from the outer surface of the side wall 15. The can 12 includes a bottom 18, a cylindrical side wall 19, a top 20 and a top edge 21 extending above the top 20. Although not shown, the top 20 is preferably provided with a conventional opening tab.

Figure 2:
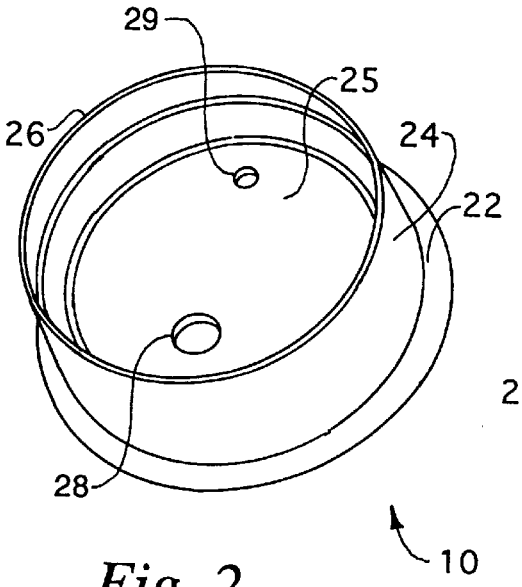
FIG. 2 is an isometric view of the mug top and can adapter of the present invention showing the top and right front side.
Figure 3:
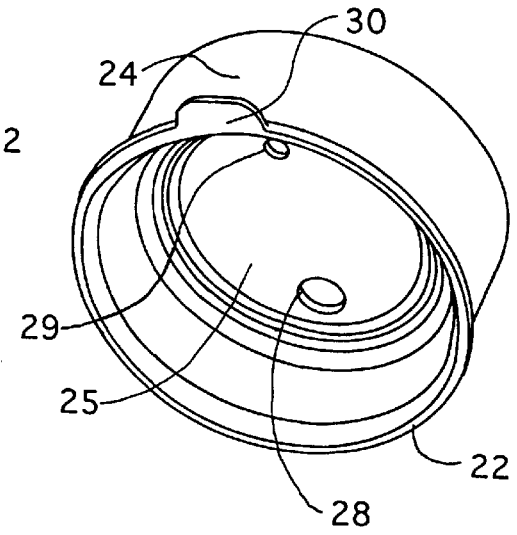
FIG. 3 is an isometric view of the mug top and can adapter of the present invention showing a bottom, rear and left side.

With continuing reference to FIG. 1 and with additional reference to FIGS. 2 and 3, the mug top and can adapter 10 includes a mug engaging edge 22, a generally cylindrical side wall 24, an adapter top and a top dispensing edge 26. As shown best in FIGS. 2, 3 and 4, the adapter top 25 includes both a dispensing opening 28 and a vent hole 29. A top removal tab 30 is integrally formed with the top preferably at the mug connection edge 22.

Figure 4:
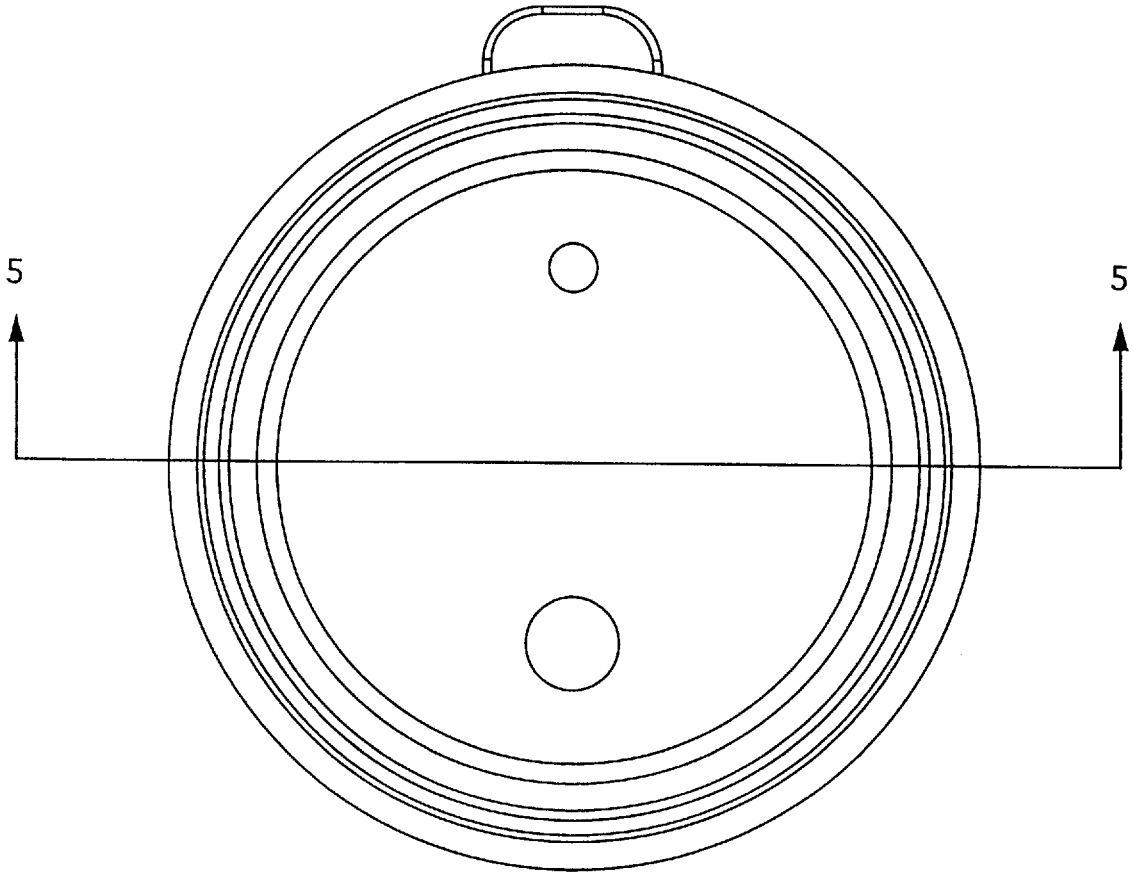
FIG. 4 is a top elevational view of the mug top and can adapter of the present invention.
Figure 5:
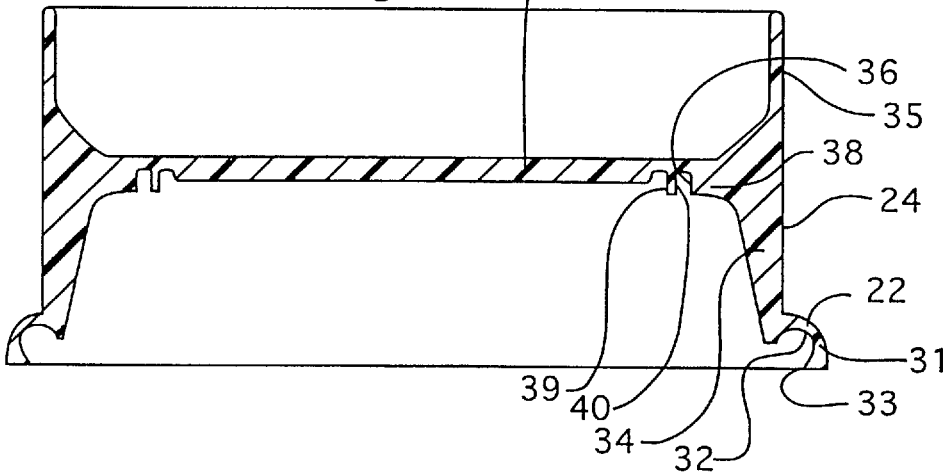
FIG. 5 is a sectional view as viewed along the section line 5—5 of FIG. 4.

Reference is next made to FIG. 5 illustrating a sectional view of the mug top and can adapter of the present invention as viewed along the section line 5—5 of FIG. 4. As shown, the mug connection edge 22 includes an outwardly extending connection leg 31 designed to be snapped over the top edge 16 of the mug 11 as shown in FIG. 1. The leg 31 defines an inner radius 32 and a retaining edge 33 for retaining engagement with the mug. In the preferred embodiment the top and can adapter 10 is constructed of a plastic material and the leg 31 is flexible enough to permit the same to be deformed and snapped over the top edge 16 of the mug 11 (FIG. 1) and retained in such position and substantially sealing relationship.

Figure 6:
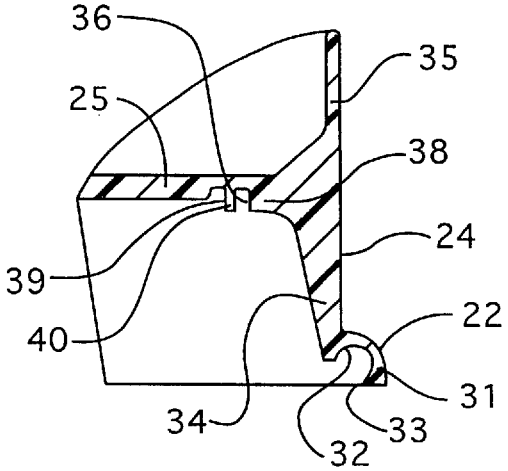
FIG. 6 is an enlarged sectional view of a portion of FIG. 5 showing details of the mug engaging edge and the can engaging means.

As shown in FIGS. 5 and 6, the side wall 24 preferably includes two portions: a first portion 34 extending between the mug engaging edge 22 and the adapter top 25 and a second portion 35 extending between the adapter top 25 and the top edge 26. In the present embodiment, the outer surface of the side wall is cylindrical, while the inner surface of the wall portion 34 slopes inwardly to transition with the adapter top 25. As shown, the adapter top 25 spans the entire area within the generally cylindrical side wall 24 and is positioned intermediate between the mug engaging edge 22 and the top edge 26.

The bottom surface of the adapter top 25 is provided with means for engaging the top edge 21 of a can 12 (FIG. 1) in substantially sealing relationship. In the preferred embodiment illustrated in FIGS. 5 and 6, this means includes the inner annular edge or surface 36 of the shoulder 38 for a standard sized wide can and the inner annular edge or surface 39 of the ring lip 40 for a standard sized narrow can. It should be noted that both the surface 38 and the surface 39 are annular surfaces which are sized to conform with the two conventional sizes of soft drink cans. Because the cup top and can adapter 10 is constructed of plastic, the shoulder 38 and the lip 40 have enough flexibility and compressibility to accommodate slight variations in can size and adapter top size due to manufacturing tolerances and the like.

The adapter top 25 is generally circular as shown in FIGS. 2, 3 and 4 and joins the generally cylindrical side wall 24 intermediate between its top edge 26 and its mug connecting edge 22. As shown best in FIG. 5, the lengths of the surfaces 36 and 39 relative to the bottom surface of the adapter top 25 are designed to accommodate a recessed area in the top of the can extending between the can top edge 21 and the can top 20 as shown in FIG. 1. Thus, when a can is inserted into retaining relationship with either the surface 36 or 39 there is a slight open space between the can top 20 (FIG. 1) and the bottom of the top adapter 25 to allow air to pass through the vent opening 29 and into the opening of the can.

Figure 7:
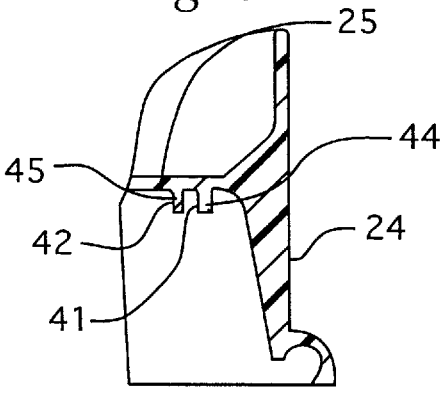
FIG. 7 is an enlarged sectional view, similar to that of FIG. 6, of a first alternate embodiment in accordance with the present invention.

Reference is next made to FIG. 7 which is similar to the construction of the preferred embodiment except that it includes an alternate means for retaining the can in a sealed relationship. In the embodiment of FIG. 7, such means includes the inner annular surfaces 41 and 42 of a pair of radially spaced ring lips 44 and 45, respectively.

Figure 8:
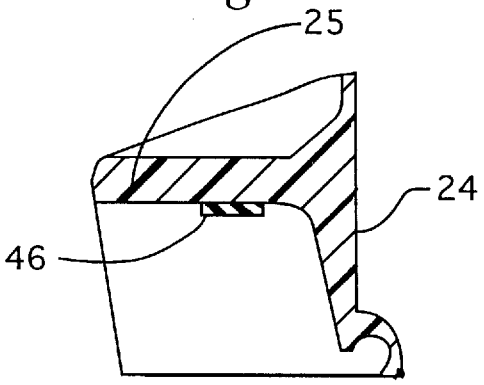
FIG. 8 is an enlarged sectional view, similar to that of FIGS. 6 and 7, of a second alternate embodiment of the present invention.

FIG. 8 is a further embodiment of the present invention which is similar to that of preferred embodiment except for the means of engaging the top edge of the can. In the embodiment of FIG. 8, this means includes a flat, circular gasket 46 constructed of a gasket material such as foam rubber. The gasket 46 is secured to the bottom surface of the adapter top 25 by an appropriate adhesive or the like. In the embodiment of FIG. 8, the top edge of the can is pressed against the gasket and retained in that position by the retaining force of the edge 22 snapped to the top edge of the mug.

To use the device of the present invention, the mug top and can adapter is positioned onto the top of a soft drink or other beverage can so that the top edge 21 (FIG. 1) of the can engages the can engaging means. The can is then placed into the mug and the edge 22 snapped onto the top edge of the mug. In this position, the can and its contained beverage is maintain in a cold condition. When it is desired to consume the beverage, the top is removed from the mug and from the can and the can is opened. Following this, the top is again placed on the can and the can inserted into the mug with the edge 22 snapped onto the top edge of the mug. The beverage may then be consumed or otherwise dispensed either immediately or over an extended period of time. In the meantime, the beverage is maintained in its chilled or cold condition while being consumed. The dispensing opening 28 in the adapter top 25 is preferably aligned with the opening in the can. This permits use of a straw to consume the beverage.

Although the description of the preferred and alternate embodiments has been quite specific, it is contemplated that various modifications could be made to the invention without deviating from the spirit of the present invention.

Accordingly, it is intended that the scope of the present invention be dictated by the appended claims rather than by the description of the preferred embodiment.

We claim:

1. A beverage dispensing mug for receiving a beverage can having a top edge portion, comprising:

a mug base having a bottom wall and a side wall extending upwardly from said bottom wall and defining a can receiving cavity, said side wall including a top edge;

a mug top having a connection edge for selective connecting engagement with said top edge, a top wall having an inner surface facing said can receiving cavity when said connection edge is in connecting engagement with said top edge and a mug top side wall extending between said connection edge and said top wall, said mug top side wall including a bottom edge defining said connection edge and a top free edge defining a dispensing lip wherein said top wall is joined with said mug top side wall between said bottom edge and said top free edge so that said dispensing lip is spaced above said top wall and further wherein said connection edge and said top edge are configured and adapted for selective snap fit engagement with one another without threads;

said inner surface including a seal member forming a seal with said can top edge portion when said beverage can is in said cavity and said connection edge is in connecting engagement with said top edge; and a beverage dispensing opening in said top wall.

2. The beverage dispensing mug of claim 1 wherein said mug is constructed of an insulative material.

3. The beverage dispensing mug of claim 1 wherein said seal member includes a lip member joined with and extending from said inner surface.

4. The beverage dispensing mug of claim 3 wherein said lip member is a closed loop circular configuration.

5. The beverage dispensing mug of claim 4 wherein lip member includes an annular surface for sealing engagement with said can top edge portion when said connection edge is in connecting engagement with said top edge.

6. The beverage dispensing mug of claim 5 wherein said annular surface is an inner annular surface.

7. The beverage dispensing mug of claim 4 wherein said beverage dispensing opening is positioned within said closed loop circular configuration.

8. The beverage dispensing mug of claim 7 including a vent hole in said top wall and positioned within said closed loop circular configuration.

9. The beverage dispensing mug of claim 3 wherein said lip member is constructed of a flexible plastic material.

10. The beverage dispensing mug of claim 1 wherein said seal member is a gasket member connected with said inner surface for sealing engagement with the top edge portion of said can.

11. The beverage dispensing mug of claim 1 wherein said dispensing opening is a non-closable opening.

12. The beverage dispensing mug of claim 1 wherein the entirety of said top wall is positioned above said top edge of the mug base when said mug base and said mug top are connected.

13. An adapter top for a beverage dispensing mug base wherein said mug base includes a can receiving cavity terminating in a top edge and wherein said cavity is adapted to receive a beverage can having a top edge portion, said adapter top comprising:

a connection edge for selective snap fit connecting engagement with the top edge of said mug base and a top wall having an inner surface facing said can receiving cavity when said connection edge is in connecting engagement with said top edge;

said inner surface including a seal member forming a seal with said can top edge portion when said beverage can is in said cavity and said connection edge is in connecting engagement with said top edge;

a top side wall extending from said connector edge to a top free edge defining a dispensing lip, with said top wall intersecting said top side wall at a position between said connector edge and said free; and a beverage dispensing opening in said top wall.

14. The adapter top of claim 13 wherein said seal member includes a lip member joined with and extending from said inner surface.

15. The adapter top of claim 14 wherein said lip member is a closed loop circular configuration.

16. The adapter top of claim 15 wherein lip member includes an annular surface for sealing engagement with said can top edge portion when said connection edge is in connecting engagement with said top edge.

17. The adapter top of claim 15 wherein said beverage dispensing opening is positioned within said closed loop circular configuration.

18. The adapter top of claim 17 including a vent hole in said top wall and positioned within said closed loop circular configuration.

19. The adapter top of claim 13 wherein said seal member is a gasket member connected with said inner surface for sealing engagement with the top edge portion of said can.

20. The adaptor top of claim 13 where said dispensing opening is a non-closable opening.

* * * * *